United States Patent [19]

Ryan et al.

[11] 4,418,343

[45] Nov. 29, 1983

[54] CRT REFRESH MEMORY SYSTEM

[75] Inventors: Joseph L. Ryan, Tuscon, Ariz.; Elias Safdie; Richard R. Watkins, both of Chelmsford, Mass.; Frederick E. Kobs, East Pepperell, Mass.

[73] Assignee: Honeywell Information Systems Inc., Waltham, Mass.

[21] Appl. No.: 235,820

[22] Filed: Feb. 19, 1981

[51] Int. Cl.[3] ..... G09G 1/02

[52] U.S. Cl. ..... 340/723; 340/799; 340/803; 340/802

[58] Field of Search ..... 340/721, 723, 728, 731, 340/747, 748, 799

[56] References Cited

U.S. PATENT DOCUMENTS

| | | | |
|---|---|---|---|
| Re. 30,785 | 10/1981 | Lovercheck et al. | 340/721 X |
| 4,104,624 | 8/1978 | Hamada | 340/799 X |
| 4,197,590 | 4/1980 | Sukonick et al. | 340/721 X |
| 4,290,064 | 9/1981 | Traster | 340/799 X |
| 4,298,931 | 11/1981 | Tachiuchi et al. | 340/799 X |
| 4,326,202 | 4/1982 | Kidode et al. | 340/799 |

*Primary Examiner*—David L. Trafton

*Attorney, Agent, or Firm*—George Grayson; Nicholas Prasinos

[57] ABSTRACT

A logic memory control system for accommodating plural read/write requests to a video terminal display memory is provided without the need for multiplexing common busses shared by the video terminal logic devices accessing the display memory, or for compromising video terminal data transfer rates.

2 Claims, 5 Drawing Figures

CRT REFRESH MEMORY SYSTEM

BACKGROUND OF THE INVENTION

The present invention relates to data display systems such as video terminal systems, and more particularly to apparatus for resolving conflicts which may occur between data processing devices simultaneously accessing a display memory over a common address bus.

PRIOR ART

In video terminal systems, display memories generally are accessed by both a video controller and by a CPU. The video controller accesses the display memory to transfer display data to a video screen. The CPU accesses the display memory to write new information into the memory, and to verify the contents of the memory. Where the CPU and video controller have accessed the display memory over a common address bus, DMA type of access requests have been used. Such requests have required the multiplexing of the address bus, and the use of high speed RAMs and bus logic to accommodate communication and visual data transfer rates. The high speed logic in turn has necessitated the use of precise system wide timing control logic, without which the quality of the visual display deteriorates.

One alternative to the use of high speed logic with precise system wide timing control has been the incorporation of delay logic to place the CPU in a wait state while the video controller accesses the display memory, and to place the video controller into a wait state while the CPU accesses the display memory. The use of delay logic has proved to be unsatisfactory, however, because visible interference with the video refresh rate has occurred during CPU activity. In addition, the average CPU instruction execution rate has been too slow to accommodate communication system transfer rates.

A further alternative which has been used allows an unfettered access to the display memory by the video controller, but confines CPU activity to the retrace time periods between scan line traces on the CRT video screen. While visual aberrations thereby are avoided, the CPU instruction execution speed and the display memory refresh rate are too slow to accommodate communication system transfer rates which typically are of the order of 9600 baud and higher.

In the present invention, display memory access is provided without the need for address bus multiplexing, DMA type accessing, high speed logic and precise system wide timing. Slower RAMs and bus rates are used with local video rather than system wide timing circuits without adversely affecting information transfer rates of the CPU instruction execution speed.

SUMMARY OF THE INVENTION

A logic memory control system is provided for a video terminal system of a CPU, a memory unit, a video control system, a timing control system and a communication system each connected to the others by common system address, data and control busses, wherein the accessing of a display memory by both the CPU and the video control system over the common system address bus is accommodated without multiplexing the system address bus or compromising either system data transfer rates or CPU instruction execution speeds.

More particularly, the logic memory control system includes multiplexer information transfer logic interposed between the system address bus and video address and control busses which are internal to the video control system and which lead to display memory inputs. In response to a time divided control signal received from the timing control system, the multiplexer information transfer logic selectively accommodates both CPU and video control system access requests without adversely affecting system data transfer rates or CPU instruction execution speeds. Selected segments of the display memory thereby may be addressed under video control system rather than system wide timing control in providing binary video character and visual attribute codes to video display logic.

DESCRIPTION OF THE DRAWINGS

For a more complete understanding of the present invention and for further objects and advantages thereof, reference may now be had to the following description taken in conjunction with the accompanying drawings in which.

DESCRIPTION OF THE PREFERRED EMBODIMENT

FIG. 1

Figure 1:
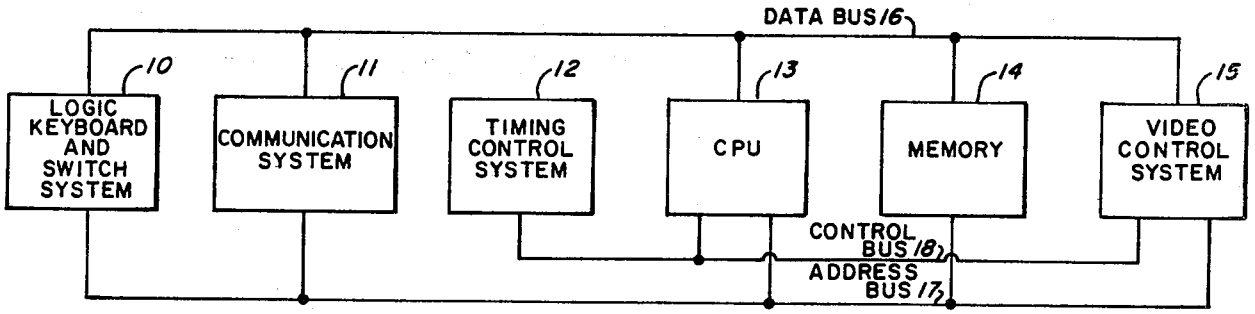
FIG. 1 is a functional block diagram of a video terminal display system having system components electrically coupled to common data, address and control busses.

FIG. 1 illustrates in functional block diagram form a video terminal display system comprising a logic keyboard and switch system 10, a communication system 11, a timing control system 12, a central processing unit (CPU) 13, a memory unit 14 and a video control system 15. Communication between the devices comprising the video terminal display system is accomplished by way of an eight bit bidirectional data bus 16, a sixteen bit address bus 17 and a four bit control bus 18.

The logic system 10 and the communication system 11 provide means for entering data into the display system. More particularly, a user may enter data manually by way of logic system 10, or data may be entered from a host CPU by way of communication system 11. The timing control system 12 generates the system bus timing cycles for the data bus 16, the address bus 17 and the control bus 18.

In the preferred embodiment disclosed herein, the memory unit 14 is comprised of a 1.0K by a 8.0 bit random access memory (RAM), and a 6.0K by 8.0 bit read only memory (ROM). Microprogrammed subroutines are stored in the ROM to control overall system operation. Sections of the RAM, however, are set aside as registers, buffers and work areas to be used during system operation. The memory unit 14 is accessed only by the CPU 13 by way of address bus 17. During a memory read cycle, a data word is read from the memory unit to the data bus 16. During a memory write cycle, a data word is received from the CPU 13 by way of data bus 16, and is written into the memory location addressed by the CPU on the address bus 17. The CPU 13 thus reads or writes into the RAM of the memory unit 14 to accommodate necessary system bookkeeping, and controls the overall system operation through access to the microprogrammed subroutines stored in the ROM of the memory unit 14.

The CPU 13 further may access the logic system 10 or communication system 11 by way of address bus 17 to transfer data received from such systems to either the memory unit 14 or the video control system 15. In addition, the CPU may access memory units within the video control system 15 to either write video data into such memory units, or to read video data stored in the memory units for transfer to the logic system 10 or communication system 11.

A brief description of control signals generated and received by the timing control system 12 by way of control bus 18 during system operation are described below:

CPURWC+00 (CPU Read Write Control)

The CPU Read Write Control signal indicates the type of data transfer occurring on the data bus 16. When the signal is at a logic one level during a CPU cycle, data is read from a device such as memory unit 14 to the data bus 16 under CPU control. When the signal is at a logic zero level, data on the data bus 16 is written under CPU control into the memory unit 14.

BRESET−00 (Bus Reset)

The Bus Reset signal is used by the CPU 13 to clear registers and reset flip-flops throughout the video terminal display system. System reset occurs when the signal transitions to a logic zero level.

CPUVMA+00 (CPU Valid Memory Address)

The CPU valid memory address signal indicates the occurrence of a time period during which memory address signals appearing on the address bus 17 are valid. When the CPU signal is at a logic zero level, the memory address lines are invalid. When the CPU signal is at a logic one level, however, the memory address lines are valid and may be used.

CPUIRO−Q0 (CPU Interrupt Request)

The CPU interrupt request signal indicates to the CPU that a device on a system bus requires servicing. When the signal is at a logic one level, no servicing is required. When the signal is at a logic zero level, however, the CPU is interrupted to terminate any existing program execution and to initiate a service routine program for the interrupting device.

The invention disclosed herein is embodied in the video control system 15 which controls the access to a display memory internal to the control system as shall be further described.

FIG. 2

Figure 2:
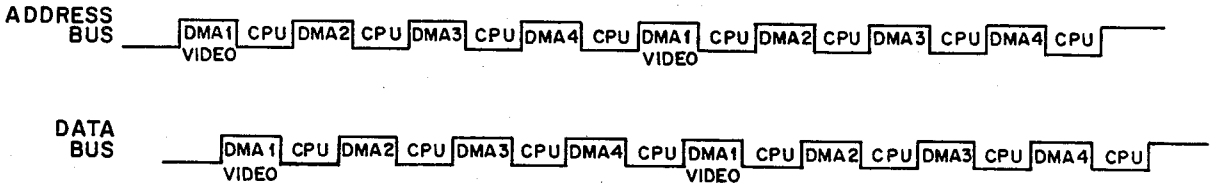
FIG. 2 is a timing diagram of bus cycles occurring in the common busses of FIG. 1 in accordance with prior art systems.

FIG. 2 illustrates in timing graph form the splitting of system bus time periods into alternate CPU cycles and DMA cycles as required by prior systems.

Referring to FIG. 2, the address bus and data bus cycle times are divided into DMA and CPU cycle channels. The DMA cycles occur in order as DMA1, DMA2, DMA3, and DMA4 cycles.

In prior systems, the CPU would be operative only during CPU cycles occurring on the data bus 16 or the address bus 17. The video control system 15 of FIG. 1 would be exclusively assigned to the operative during one of the DMA cycles to provide a CRT video display with continuous refresh information from the memory unit 14. In the present invention as described herein, no such multiplexing of system address and data busses is required.

FIG. 3

Figure 3:
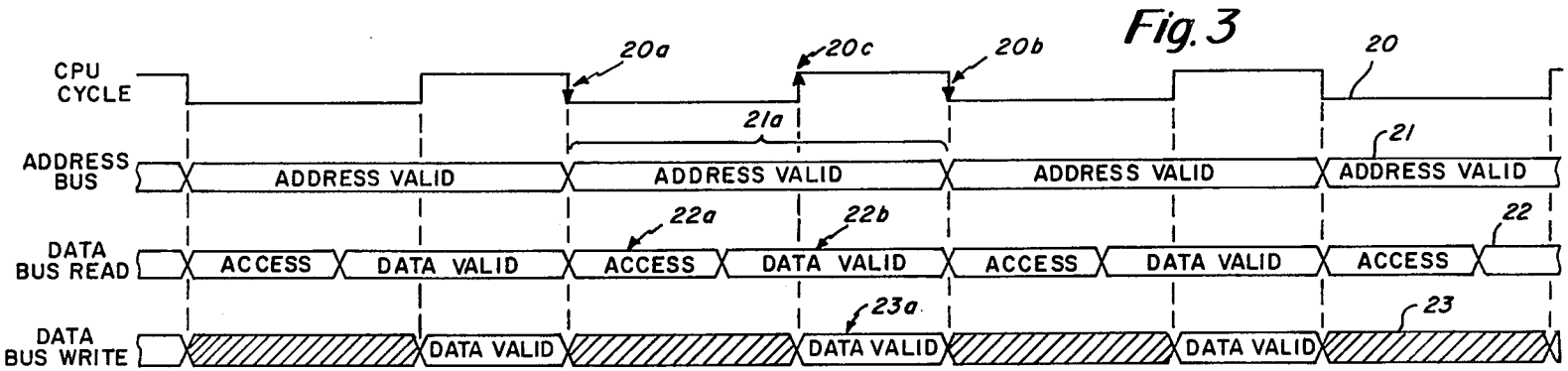
FIG. 3 is a timing diagram of bus cycles occurring in the common busses of FIG. 1 in accordance with the present invention.

FIG. 3 illustrates in timing graph form the bus cycles occurring in the address bus 17 and the data bus 16 of FIG. 1 in accordance with the present invention.

A waveform 20 illustrates the CPU 13 duty cycles during which the CPU controls all transactions occurring on system busses including data bus 16, address bus 17 and control bus 18. A waveform 21 illustrates the address bus refresh cycle during which the CPU 13 issues a device address to the bus. A waveform 22 illustrates bus cycles occurring on the data bus 16 during a data read operation. A waveform 23 illustrates bus cycles occurring on the data bus 16 during a data write operation.

During a data read operation, the CPU issues a device address to the address bus 17 upon the occurrence of a trailing edge of a CPU cycle as illustrated at 20*a*. The device address remains on the address bus during the following CPU cycle as illustrated at 21*a*. Following an access delay as illustrated at 22*a*, the addressed device issues a data byte to the data bus 16 as illustrated by the time period 22*b*. The CPU 13 operates upon the data byte or transfers the data byte to another device upon the occurrence of a next trailing edge in the waveform 20 as illustrated at 20*b*.

In a data write operation, the CPU 13 as before described issues a device address to the address bus 17 upon the occurrence of a trailing edge of a CPU cycle as illustrated at 20*a*. Upon the occurrence of a next rising edge of the waveform 20 as illustrated at 20*c*, the CPU places data on the data bus 16 as illustrated by the time period 23*a*. The device addressed by the CPU on the address bus 17 thereupon samples the data on data bus 16 prior to the occurrence of a next trailing edge of a CPU cycle as illustrated at 20*b*.

FIG. 4

Figure 4:
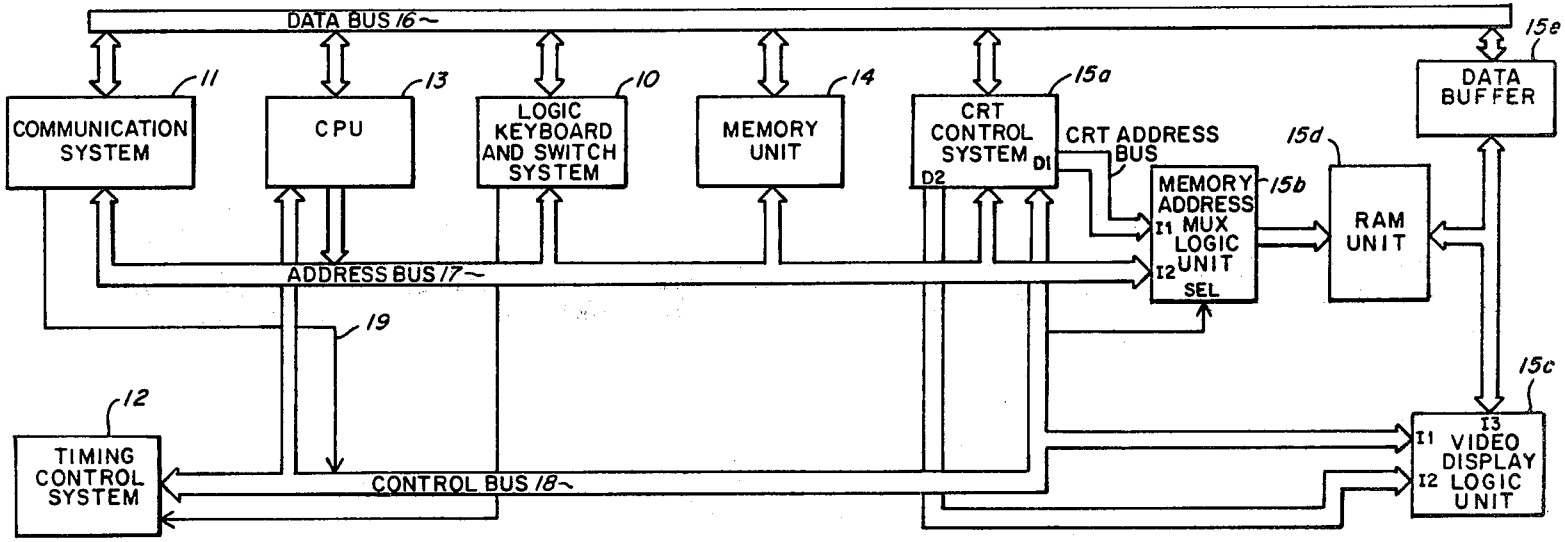
FIG. 4 is a detailed functional block diagram of the video terminal display system of FIG. 1 in accordance with the present invention.

FIG. 4 illustrates in functional block diagram form the video terminal display system of FIG. 1 including a more detailed block diagram of the video control system 15 in accordance with the present invention. It is to be understood that the use of like reference numbers in FIGS. 1 and 4 indicates like logic devices.

Referring to FIG. 4, a CRT control system 15*a* is in electrical communication with data bus 16, address bus 17 and control bus 18. An eleven-bit D1 output of the control system is applied to the I1 input of a memory address multiplexer logic unit 15*b*, and a four-bit D2 output of the control system is applied to the I2 input of a video display logic unit 15*c*. The I2 input of the multiplexer logic unit 15*b* is connected to the address bus 17, and the output of the multiplexer logic unit is applied to the input of a 2.0K by 16.0 bit random memory (RAM) unit 15*d*. A character clock signal to be later described is applied by the timing control system 12 along the control bus 18 to the SEL (select) input to the multiplexer logic, to the I1 input of the video display logic unit 15*c* and to the I2 input of the CRT control system 15*a*.

The I3 input of the video display logic unit is connected to a sixteen-bit input/output of RAM unit 15*d* and to an input/output of an eight-bit data buffer 15*e*. A second input/output of the data buffer is connected to the data bus 16.

The CRT control system 15*a*, memory address multiplexer logic unit 15*b*, video display logic unit 15*c*, RAM unit 15*d* and data buffer 15*e* comprise the video control system 15 of FIG. 1.

In operation, the video terminal display system may receive video data from the logic keyboard and switch system 10, or from a host CPU by way of the communication system 11. If data is supplied by a host CPU, the data is accepted by the communication system 11 and formed into an eight-bit video character code. The communication system thereupon generates a first interrupt by way of the control line 19 to the timing control system 12. In response thereto, the system 12 generates a second interrupt through the control bus 18 to the CPU 13. Upon receiving the second interrupt, the CPU applies a twelve-bit address code to the address bus 17 to store the video character code of the communication system 11 in either the memory unit 14, or in the RAM unit 15*d* by way of the data buffer 15*e*. The memory unit 14 is used as a temporary storage for video data in the event bus access conflicts occur. When the time conflicts have been overcome, the CPU shall retrieve the video data from memory unit 14 for storage in the RAM unit 15*d*.

When the CPU 13 applies a memory address code to the I2 input of the multiplexer logic unit 15*b*, and the multiplexer logic unit is selected by the timing control system 12 under CPU control to the I2 input, a binary video character or visual attribute code stored in the data buffer 15*e* may be written into the addressed memory location of the RAM unit 15*d*. In the alternative, data stored in the addressed memory location may be read for storage in the data buffer 15*e*. More particularly, if video data stored in the RAM unit 15*d* is to be transferred by way of the communication system 11 to a host CPU, the CPU 13 shall issue a twelve-bit address code by way of the multiplexer logic unit 15*b* to the RAM unit 15*d*. The output of the RAM unit thereupon is applied through the data buffer 15*e* under CPU control to the data bus 16. The communication system 11 thereafter may forward the data on the data bus to the host CPU.

If video data is entered by way of the logic key-board and switch system 10 rather than the communication system 11, the system 10 may generate an interrupt to the timing control system 12. The operation of the system thereafter is as before described.

At the time of system initialization, the CPU 13 addresses the CRT control system 15*a* by way of the system address bus 17, and issues a write enable signal on the control bus 18. The CPU thereafter writes configuration data appearing on the data bus 16 into the configuration control registers of the control system. The configuration data includes scan line count, character position count, characters per scan line, cursor position, and initial RAM address information.

During system operation, the CRT control system 15*a* generates sequential address codes at its D1 output to address the RAM unit 15*d*. In addition, the control system generates horizontal sync, vertical sync, screen blanking and other timing signals at its D2 output for controlling the display of information on a video screen. More particularly, when character data and visual attribute data stored in the RAM unit 15*d* are to be supplied to the video display logic unit 15*c*, the CRT control system 15*a* issues eleven bit address codes to the I1 input of the logic unit 15*b* at a 1.88 Mhz character clock rate. Eight bit segment pairs of the RAM unit are addressed in response to each address code, and sixteen bit data words stored in the addressed memory locations are applied to the I3 input of the video display logic unit 15*c*. The video display logic unit 15*c* interprets each data word as being comprised of eight bits of character data and eight bits of visual attribute data.

FIG. 5

Figure 5:
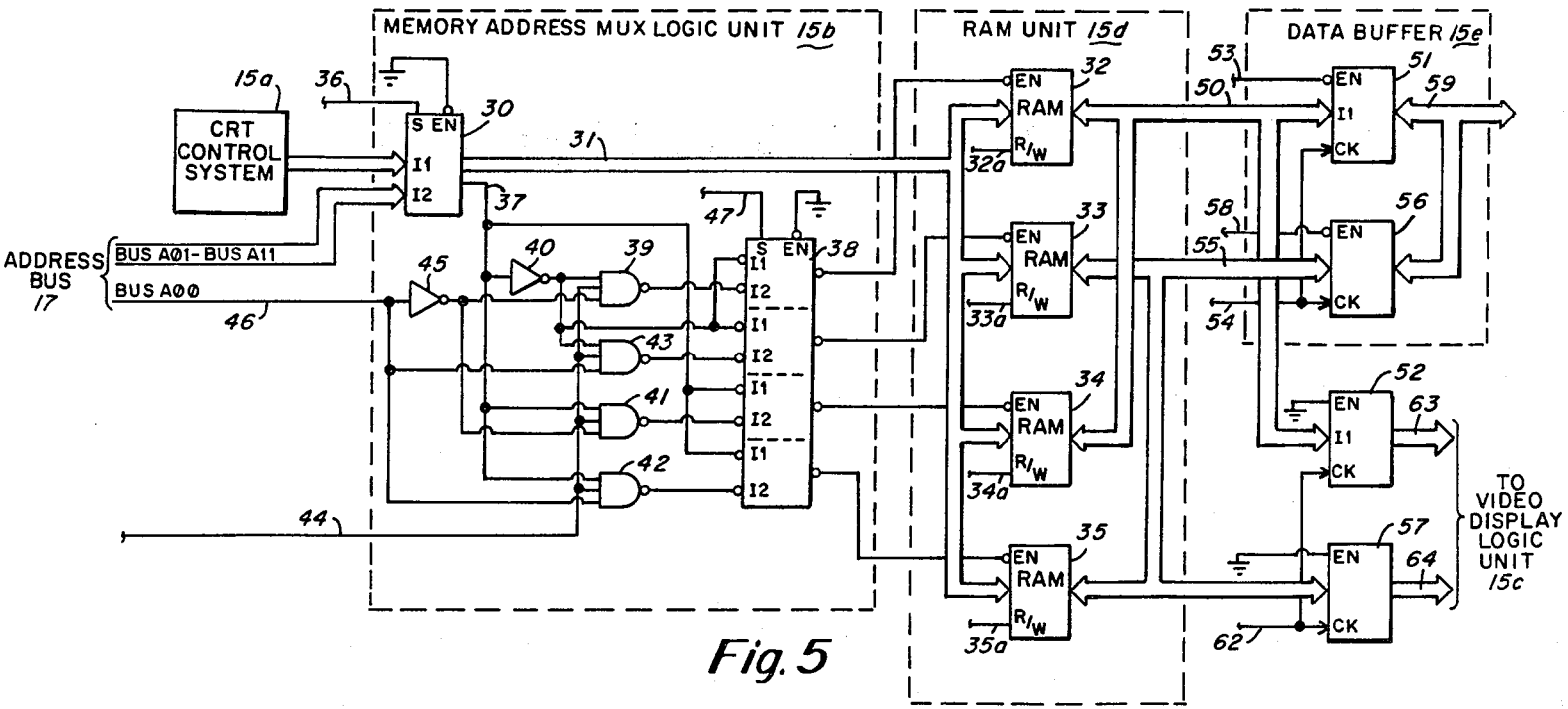
FIG. 5 is a detailed logic diagram of the memory address multiplexer logic unit, the RAM unit and the data buffer of FIG. 4.

FIG. 5 illustrates in a more detailed logic diagram form the memory address multiplexer logic unit 15*b*, the RAM unit 15*d* and the data buffer 15*e* of FIG. 4.

In referring to the electrical schematics illustrated in the Figures, it is to be understood that the occurrence of a small circle at the input of a logic device indicates that the input is enabled by a logic zero. Further, a circle appearing at an output of a logic device indicates that when the logic conditions for that particular device are satisfied, the output will be a logic zero.

Referring to FIG. 5, the CRT control system 15*a* as before described supplies on eleven bit address to the I1 input of the logic unit 15*b*. More particularly, the output of system 15*a* is applied to the I1 input of a multiplexer 30 comprising a component part of the logic unit 15*b*. The I2 input of multiplexer 30 is an eleven-bit supplied by way of the address bus 17. The select input to the multiplexer 30 is connected to a control line 36 leading to an output of the timing control system 12 of FIG. 4. The enable light to the multiplexer 30 is connected to ground.

A ten-bit output of multiplexer 30 is applied by way of a data bus 31 to a 1.0K×8.0-bit RAM 32, a 1.0K×8.0-bit RAM 33, a 1.0K×8.0-bit RAM 34, and a 1.0K×8.0-bit RAM 35. The most significant bit output of the multiplexer 30 is applied to a control line 37 leading to the I1 input of the third and fourth stages of a four-stage multiplexer 38. The most significant bit output of multiplexer 30 further is applied to one input of a NAND gate 39 by way of an inverter 40, to one input of a NAND gate 41 and to one input of a NAND gate 42.

The output of the inverter 40 also is applied to one input of a NAND gate 43, and to the I1 inputs of the first and second stages of multiplexer 38. A second input to the NAND gates 39, 41, 42 and 43 is a logic signal supplied by a control line 44 leading from the timing control system 12 of FIG. 4. The logic signal is issued at such a time as to ensure that the RAM unit 15*d* is not enabled before a write mode select control signal issued by the CPU 13 is received by the RAM unit during a data write operation. A third input to the NAND gate 39 is supplied by the output of an inverter 45, the input of which is connected to an address line 46 carrying the least significant bit signal of the address bus 17. The output of inverter 45 further is connected to a third input of gate 41. The control line 46 also is connected to a third input of the NAND gate 43 and to a third input of the NAND gate 42.

The output of the NAND gate 39 is applied to the I2 input of the first stage of the multiplexer 38, and the output of the NAND gate 43 is supplied to the I2 input of the second stage of the multiplexer. The output of the NAND gate 41 is applied to the I2 input of the third stage of the multiplexer 38, and the output of the NAND gate 42 is applied to the I2 input of the fourth stage of the multiplexer. The select input to the multiplexer 38 is a time divided character clock signal supplied by the timing control System 12 of FIG. 4 by way of a control line 47, and the enable input of the multiplexer is connected to ground.

The multiplexers 30 and 38, the inverters 40 and 45, and the gates 39, 41, 42 and 43 comprise the address multiplexer logic unit 15*b* of FIG. 4.

The first stage output of the multiplexer 38 is applied to the enable input of the RAM 32, and the second stage output of the multiplexer is applied to the enable input of RAM 33. The third stage output of the multiplexer 38 is supplied to the enable input of RAM 34, and the fourth stage output of the multiplexer is supplied to the enable input of RAM 35.

An input/output port of RAM 32 is connected by way of a bidirectional tri-state communication bus 50 to the I1 input of an eight bit reigster 51. The bus 50 further is connected to an input/output of the RAM 34, and to the I1 input of an eight-bit holding register 52. The enable input to the register 51 is supplied by the timing control system 12 by way of a control line 53, and the clock input to the register is a time divided character clock control signal supplied by the timing control system by way of a control line 54.

An input/output of RAM 33 is applied to a bidirectional tri-state communication bus 55, which also is connected to the input of an eight-bit register 56, to the input of an eight-bit register 57, and to an input/port of RAM 35.

The read/write mode select (R/W) inputs to the RAMs 32–35 are supplied by the CPU 13 by way of control line 32*a*, 33*a*, 34*a* and 35*a* respectively.

The enable input of register 56 is connected to a control line 58 leading from an output of the timing control system 12, and the clock input to the register is connected to control line 54. An input/output port of register 56 is connected by way of a bi-directional tri-state bus 59 to the data bus 16 of FIG. 4 and to the output of register 51.

The enable inputs to registers 52 and 57 are connected to ground. The clock inputs to registers 52 and 57 are connected to a control line 62 leading from a time divided character clock timing control system 12. The output of the register 52 is an eight-bit output which is applied by way of a data bus 63 to the video display logic unit 15C of FIG. 4. The output of the eight-bit register 57 is applied by way of a data bus 64 to the video display logic unit.

The RAMS 32, 33, 34 and 35 comprise the RAM unit 15*d* of FIG. 4. In the preferred embodiment disclosed herein, the RAMs comprising RAM unit 15*d* may be of the type manufactured and sold by the Intel Corporation of Santa Clara, Calif., and identified to the public as RAM 2114AL-4. The registers 51 and 56 comprise the data buffer 15*e* of FIG. 4.

In operation, the timing control system 12 of FIG. 4 generates clock signals from a 16.948 MHz oscillator a shall be further described to control the operation of the multiplexers 30 and 38, gates 39 and 41–43, data buffer 15*e* and registers 52 and 57. During a video data refresh cycle, the CRT control system 15*a* applies an 11-bit address code by way of the multiplexer 30 to a control line 37 and to the 10-bit data bus 31 addressing RAMs 32–35. When the most significant bit output of the multiplexer 30 on control line 37 is at a logic one level, the stage I and stage II outputs of multiplexer 38 enable RAMs 32 and 33. When the control line 37 is at a logic zero level, however, the stage III and stage IV outputs of multiplexer 38 enable the RAMs 34 and 35. The RAMs 32 and 34 have binary video character codes stored therein, while the RAMs 33 and 35 contain binary visual attribute codes. The RAMs 32 and 34 have same memory location addresses, and the RAMs 33 and 35 have same memory location addresses succeeding those of RAMs 32 and 34. Whether the RAMs 32 and 33 of the RAMs 34 and 35 are addressed and enabled, the output of the RAMs are latched into the holding registers 52 and 57 pending transfer to the video display logic unit 15*c* of FIG. 4.

During a CPU read or write cycle, twelve bits of address information are supplied by way of the address bus 17 to control line 46 and multiplexer 30. The eleven most significant bits are applied through the multiplexer to the data bus 31 and control line 37, collectively. At least significant bit logic signal is applied to the control line 46.

The control line 37 selects between a first RAM pair comprised of the RAMs 32 and 33, and a second RAM pair comprised of the RAMs 34 and 35. The control line 46, however, selects between the RAMs comprising a selected RAM pair. Thus, during a CPU cycle, a video character RAM 32 or 34 is selected if the control line 46 is at a logic zero level. If the control line is at a logic one level, however, a visual attribute RAM 33 or RAM 35 is selected. If the RAM 32 or the RAM 34 is selected, the output of the RAM is latched into register 51 or register 52. If the RAM 33 or the RAM 35 is selected, however, the output of the RAM is latched into register 56 or register 57. The registers 51 and 56 are connected by way of the tri-state bus 59 to the data bus 16 of FIG. 4. The video character codes stored in register 52 and the visual attribute codes stored in register 57 are forwarded to the video display logic unit 15*c* of FIG. 4.

FIG. 6

Figure 6:
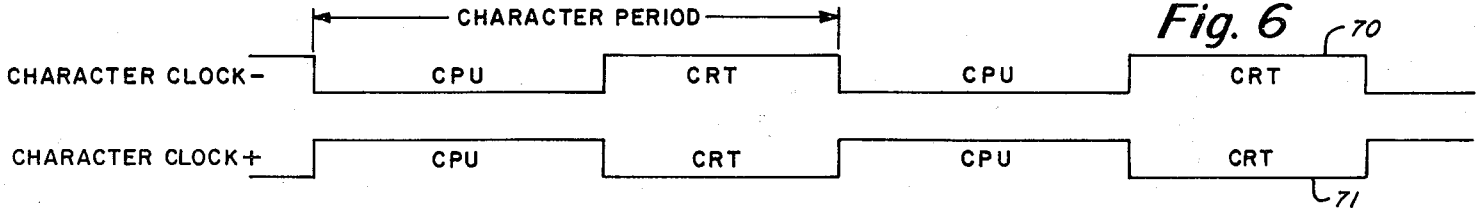
FIG. 6 is a timing diagram of the operation of the logic system of FIG. 5.

FIG. 6 illustrates in timing graph form the operation of the logic system of FIG. 5.

Referring to FIG. 6, waveforms 70 and 71 illustrate character clock signals one hundred-eighty degrees out of phase. In the preferred embodiment disclosed herein each signal is derived from a 16.948 MHz signal, and exhibits a full cycle time period (T) of approximately 531.0 nanoseconds. The cycle time period is comprised of 5T/9 CPU time period and a 4T/9 CRT time period.

The character clock signal of form wave 70 is applied to the select input of multiplexer 30, and to the clock inputs of registers 51 and 56 of FIG. 5. The character clock signal of waveform 71 is applied to the select input of multiplexer 38, and to the clock input of registers 52 and 57 of FIG. 5.

In operation, the multiplexers 30 and 38 act in concert to provide the CPU 13 and the CRT control system 15*a* access to the RAM unit 15*d*. During the time period that waveform 70 is at a logic one level and waveform 71 is at a logic zero level, the CRT control system 15*a* may address the RAM unit. The CPU 13 may address the RAM unit during those time periods that the waveform 70 is at a logic zero level and the waveform 71 is at a logic one level. Further, data may be written into the registers 52 and 57 when the waveform 71 is at a logic one level, and data may be written into registers 51 and 56 when waveform 70 is at a logic one level.

Having described the invention in connection with certain specific embodiments thereof, it is to be understood that further modifications may now suggest themselves to those skilled in the art, and it is intended to cover such modifications as fall within the scope of the appended claims.

What is claimed is:

1. A video control system for a video terminal having video display logic, and further having a timing control system, a communication system, a central processing unit (CPU) and a main memory unit each in electrical communication with the other by way of an address bus, a data bus and a control bus operating at CPU clock rates, said video control system comprising:

(a) a CRT control system for receiving video control configuration parameters from said data bus under control of the CPU and, responsive to a time divided character clock control signal received from said timing control system and to said configuration parameters, for controlling the operation of said video display logic and generating binary address codes representative of video characters and visual attributes;

(b) multiplexer logic means responsive to said character clock control signal and in electrical communication with said address bus and said CRT control system for selecting binary address codes supplied by said CPU on the address bus during a first segment of the character clock control signal or binary address codes supplied by said CRT control system during a second segment of the character clock control signal; and (c) memory logic means responsive to said character clock control signal, to mode selection control signals received from said CPU, and to binary address codes received from said multiplexer logic means for receiving under control of said CPU binary video character and visual attribute codes from said communication system by way of said data bus during said first segment of the character clock control signal, and for supplying said binary video character and visual attribute codes under the control of said CRT control system to said video display logic during said second segment of the character clock control signal.

2. A video control system for a video terminal having video display logic, and further having a timing control system, a communication system and a central processing unit (CPU) each in electrical communication with the other by way of an address bus, a data bus and a control bus, said video control system comprising:

(a) A CRT control system for receiving video control configuration parameters from said data bus under the control of said CPU and, responsive to the configuration parameters and to a time divided character clock control signal received from said timing control system, for generating binary address codes representative of video characters and visual attributes and timing control signals for application to said video display logic in displaying said video characters and visual attributes;

(b) a data buffer register in electrical communication with said data bus for exchanging binary video character and visual attribute codes with said data bus under the control of said CPU;

(c) random access memory logic means in electrical communication with said data buffer register for storing binary video character and visual attribute codes under the control of said CPU; and (d) multiplexer logic means responsive to said character clock control signal for selectively applying binary address codes received from said CRT control system to said random access memory logic means to provide binary video character and visual attribute codes from the random access memory logic means to said video display logic during one segment of the character clock control signal and applying address codes issued by said CPU on said address bus to said random access memory logic means during another segment of the character clock control signal to accommodate, under CPU control, an exchange of binary video character and visual attribute codes between said communication system and said random access memory logic means by way of said data buffer register in a memory read or a memory write operation occurring at communication system information transfer rates.

* * * * *